US011047271B2

(12) United States Patent
Jeon et al.

(10) Patent No.: US 11,047,271 B2
(45) Date of Patent: Jun. 29, 2021

(54) SOCKET MODULE OF COMPRESSION RELEASE TYPE ENGINE BRAKE AND OPERATING METHOD OF ENGINE BRAKE USING THEREOF

(71) Applicants: HYUNDAI MOTOR COMPANY, Seoul (KR); KIA MOTORS CORPORATION, Seoul (KR)

(72) Inventors: Jae Hee Jeon, Hwaseong-si (KR); Dong Hyuk Choi, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/926,100

(22) Filed: Jul. 10, 2020

(65) Prior Publication Data

US 2021/0102482 A1 Apr. 8, 2021

(30) Foreign Application Priority Data

Oct. 7, 2019 (KR) ..... 10-2019-0123903

(51) Int. Cl.
*F01L 13/06* (2006.01)
*F01L 1/18* (2006.01)
(Continued)

(52) U.S. Cl.
CPC ..... *F01L 13/065* (2013.01); *F01L 1/047* (2013.01); *F01L 1/18* (2013.01); *F01L 1/2416* (2013.01);
(Continued)

(58) Field of Classification Search
CPC . F01L 1/181; F01L 1/2411; F01L 2001/2444; F01L 1/26; F01L 1/46; F01L 13/065
(Continued)

(56) References Cited

U.S. PATENT DOCUMENTS 6,253,730 B1 7/2001 Gustafson
6,594,996 B2 * 7/2003 Yang ..... F02D 23/00 60/602
(Continued)

FOREIGN PATENT DOCUMENTS

EP 2662542 B1 8/2017
EP 2905450 B1 5/2018
(Continued)

*Primary Examiner* — Jorge L Leon, Jr.
(74) *Attorney, Agent, or Firm* — Brinks Gilson & Lione

(57) ABSTRACT

A compression release type of engine brake socket module is provided between an exhaust rocker arm rotating with respect to a rocker arm shaft and a valve bridge connecting an exhaust valve of an engine. In particular the socket module incudes: a housing which includes an inlet through which brake oil is introduced, a brake piston mounting portion, and a reset member mounting portion communicating with the brake piston mounting portion; a brake piston that is provided to be movable in the brake piston mounting portion; a stopper disposed on one side of an inner space of the housing to limit a moving position of the brake piston; and a reset member that is provided in the reset member mounting portion, and that discharges the brake oil by selectively contacting a push pin coupled to an upper portion of a cylinder head.

17 Claims, 11 Drawing Sheets

(51) Int. Cl.

| | |
|---|---|
| ***F01L 1/24*** | (2006.01) |
| ***F01L 1/26*** | (2006.01) |
| ***F01L 1/46*** | (2006.01) |
| ***F01L 1/047*** | (2006.01) |

(52) U.S. Cl.
CPC *F01L 1/26* (2013.01); *F01L 1/46* (2013.01); *F01L 1/181* (2013.01); *F01L 1/2411* (2013.01); *F01L 2001/2444* (2013.01)

(58) Field of Classification Search
USPC ..... 123/90.12, 90.16, 90.36, 90.4, 90.44
See application file for complete search history.

(56) References Cited

U.S. PATENT DOCUMENTS

| | | | | |
|---|---|---|---|---|
| 2005/0211206 | A1* | 9/2005 | Ruggiero | F01L 1/2416 123/90.16 |
| 2010/0307451 | A1* | 12/2010 | Lee | F02D 13/04 123/321 |
| 2014/0137838 | A1* | 5/2014 | Girard | F01L 1/181 123/323 |
| 2016/0160711 | A1* | 6/2016 | Lee | F01L 13/065 123/321 |
| 2016/0356187 | A1* | 12/2016 | Meneely | F01L 1/181 |
| 2018/0087412 | A1* | 3/2018 | Andrisani | F01L 1/18 |
| 2018/0087413 | A1* | 3/2018 | Xi | F01L 13/065 |
| 2018/0187579 | A1* | 7/2018 | Cecur | F01L 1/18 |
| 2019/0010835 | A1* | 1/2019 | McCarthy, Jr. | F01L 13/065 |
| 2019/0055861 | A1* | 2/2019 | Persson | F01L 1/181 |
| 2020/0018243 | A1* | 1/2020 | Baltrucki | F01L 1/46 |

FOREIGN PATENT DOCUMENTS

| | | | |
|---|---|---|---|
| JP | S60-252113 | A | 12/1985 |
| JP | H09-041926 | A | 2/1997 |
| JP | H09-264114 | A | 10/1997 |
| JP | H10-110634 | A | 4/1998 |
| JP | 2872570 | B2 | 3/1999 |
| JP | 3900549 | B2 | 4/2007 |
| JP | 3968184 | B2 | 8/2007 |
| JP | 5438679 | B2 | 3/2014 |
| JP | 6495946 | B2 | 4/2019 |
| KR | 10-1997-0001897 | A | 1/1997 |
| KR | 10-2010-0132150 | | 12/2010 |
| KR | 10-1036966 | B1 | 5/2011 |
| KR | 10-1290440 | B1 | 7/2013 |
| KR | 10-1338657 | B1 | 12/2013 |
| KR | 10-2014-0057847 | A | 5/2014 |
| KR | 10-1552487 | B1 | 9/2015 |
| KR | 10-2016-0069839 | A | 6/2016 |
| KR | 10-1683527 | B1 | 12/2016 |
| KR | 10-1683529 | B1 | 12/2016 |
| KR | 10-1714124 | B1 | 3/2017 |
| KR | 10-2019-0029185 | A | 3/2019 |
| KR | 10-2019-0069221 | A | 6/2019 |

* cited by examiner

FIG. 11 "PRIOR ART"
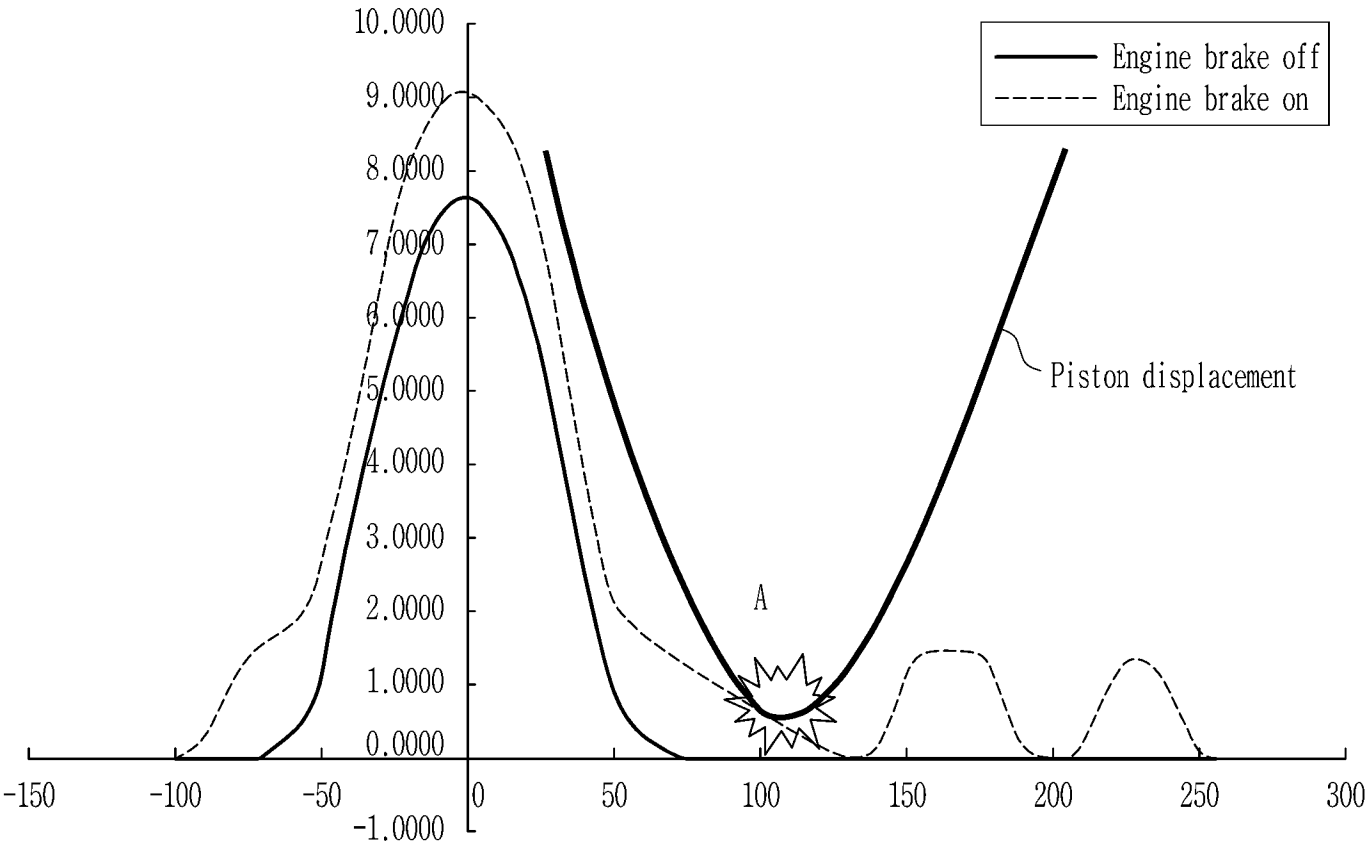

SOCKET MODULE OF COMPRESSION RELEASE TYPE ENGINE BRAKE AND OPERATING METHOD OF ENGINE BRAKE USING THEREOF

CROSS-REFERENCE TO RELATED APPLICATION

This application claims priority to and the benefit of Korean Patent Application No. 10-2019-0123903, filed on Oct. 7, 2019, the entire contents of which are incorporated herein by reference.

FIELD

The present disclosure relates to a socket module of a compression release type of engine brake, and an operation method of the engine brake using the same.

BACKGROUND

The statements in this section merely provide background information related to the present disclosure and may not constitute prior art.

In general, a brake system of an internal combustion engine vehicle uses a hydraulic pressure type of brake, but the engine brake is used to prevent premature abrasion of a brake pad during downhill driving or frequent sudden stops.

The compression release type of engine brake device, which is a type of engine brake, temporarily opens an exhaust valve near a compress top dead center of a piston during the basic four strokes of the engine, i.e., exhausts compressed air in a cylinder out of the cylinder to thereby obtain a braking effect by inducing a pumping loss of an expansion stroke.

In a compression release type of engine brake according to a conventional art, a socket module is applied between a valve bridge connected with a pair of exhaust valves, and an exhaust rocket arm.

In the socket module, the brake piston is provided inside the housing where the brake oil is introduced, and when the engine brake is operated, the brake piston moves downward to eliminate the gap between the exhaust rocker arm and the exhaust cam, thereby forcing the exhaust valve to be opened at the end of the compression stroke.

The exhaust valve is opened at the end of the compression stroke by the socket module to add braking force to the vehicle. However, we have discovered that once the engine brake oil is introduced into the socket module, it is not exhausted, and thus the valve may be opened more by oil pressure formed in the socket module.

FIG. 11 is a graph that shows a valve lift displacement amount occurring in use of a compression release type of engine brake according to a conventional art.

As shown in FIG. 11, there is a possibility of occurrence of a contact A between an exhaust valve and an engine piston.

When a compression release type of engine brake with a reset bracket is provided on one side of the socket module, the reset bracket must be applied to the outside of the reset module as well. Therefore, we have found that there is a drawback in which the overall size increases.

In addition, the socket module applied to the compress relaxes type of engine brake according to conventional art often causes a phenomenon in which the brake piston detaches from the housing when transferring or assembles parts, causing quality problems.

The above information disclosed in this Background section is only for enhancement of understanding of the background of the present disclosure, and therefore it may contain information that does not form the prior art that is already known to a person of ordinary skill in the art.

SUMMARY

The present disclosure provides a socket module of a compression release type of engine brake that can automatically initialize a pressure inside the socket module by automatically exhausting the engine brake oil that has been introduced into the socket module during engine brake operation, and an operation method of the engine brake using the same.

In addition, an exemplary form of the present disclosure applies a stopper that limits the position of the brake valve, so that the brake valve can be prevented from being detached from the housing with a simple structure.

In one form of the present disclosure, a socket module for a compression release type of engine brake is provided between an exhaust rocker arm rotating with respect to a rocker arm shaft and a valve bridge in contact with an exhaust valve of an engine. In particular the socket module incudes: a housing in which an inlet through which brake oil is introduced is formed, a brake piston mounting portion is formed, and a reset member mounting portion configured to communicate with the brake piston mounting portion is formed; a brake piston that is provided to be movable in the brake piston mounting portion; a stopper disposed on one side of an inner space of the housing to limit the moving position of the brake piston; and a reset member provided in the reset member mounting portion and configured to discharge brake oil by selectively contacting a push pin coupled to an upper portion of a cylinder head.

The socket module may further include at least one upper protrusion and a lower protrusion formed on each exterior surface of the upper and lower portions of the brake piston so that movement of the brake piston is restricted by the stopper.

A stopper mounting portion in which the stopper is mounted may be formed in the housing.

The at least one upper protrusion may include a plurality of upper protrusions, and upper protrusions of the plurality of upper protrusions may be spaced apart from each other along a circumference of the exterior surface of the upper portion of the brake piston, and the upper protrusions may enclose a certain area of an upper surface and a side surface of the upper protrusion and be connected to an upper edge of the brake piston.

An upper passage may be formed between the upper protrusions.

The stopper may include a head portion and a body portion, the body portion may be mounted through the stopper mounting portion, and an end of the body portion may be protruded into the brake piston mounting portion to position between the upper and lower protrusions.

The housing may further include a rounded mounting groove protruded upward from a upper center of the housing where an adjusting screw mounted to one end of the exhaust rocker arm is mounted.

The reset member mounting portion may include a first passage connected with the brake piston mounting portion through a first outlet and a second passage configured to discharge brake oil and connected with the first passage through a slanted surface, wherein a diameter of the second passage is smaller than a diameter of the first passage.

The brake piston may be inserted into the brake piston mounting portion, and a receiving groove is formed in an upper portion of the brake piston.

The socket module may further include a check valve that is disposed in the receiving groove, and configured to open and close the inlet by being elastically supported by a check spring.

The reset member may include a reset valve configured to move in the reset member mounting portion and open and close an outlet and a reset spring configured to elastically support a lower portion of the reset valve, and wherein when the push pin pushes the reset valve brake oil is discharged.

The reset valve may have a flow path groove that is concave inward from an upper exterior circumference of the reset valve, and an upper portion of the reset valve may be locked by a slanted surface such that an upper portion of the reset valve does not escape in a downward direction.

A method for operating a compression release engine brake using a socket module provided between an exhaust rocker arm and a valve bridge, where the socket module includes a housing including an inlet, a brake piston mounting portion and a reset member mounting portion, a brake piston, and a reset member, the method may include: providing brake oil to the brake piston mounting portion through the inlet of the housing; descending the brake piston by hydraulic pressure of the brake oil and rotating the exhaust rocker arm in a first direction relative to a rocker arm shaft such that a roller and an exhaust cam of the exhaust rocker arm contact to each other; contacting the exhaust cam to a brake cam lobe while rotating and pressing the valve bridge by the exhaust rocker arm while rotating in a second direction relative to the rocker arm shaft such that an exhaust valve is opened; and pushing a reset valve by a push pin as the exhaust rocker arm rotates such that an outlet is opened.

The providing the brake oil to the brake piston mounting portion may include introducing the brake oil into a flow path formed in an adjusting screw, and opening a check valve such that the brake oil is introduced into the brake piston mounting portion through the inlet.

The descending the brake piston may include: raising the check valve by the restoring force of the check spring to close the inlet, and at the same time, lowering the position of the brake piston so that the upper protrusion contacts the stopper and the position is limited, and supporting the brake piston by the valve bridge such that the housing is lifted, and the roller and the exhaust cam contact each other while the exhaust rocker arm rotates in the first direction relative to the rocker arm shaft.

In contacting the exhaust cam to the brake cam lobe, the exhaust rocker arm may rotate in the second direction in a section where the brake cam lobe and the roller contact each other while the exhaust cam rotates, and the exhaust valve connected to the valve bridge may be opened while the valve bridge is pressed in a downward direction.

In pushing the reset valve, the reset valve may move upward by the push pin disposed corresponding to the reset valve while the exhaust cam rotates, and a first outlet and a second outlet are opened through a flow path groove formed in the reset valve, and the brake oil introduced into the brake piston mounting portion may be discharged through the first outlet and the second outlet.

After pushing the reset valve by the push pin, the brake oil may be discharged, and the reset valve moves upward by a restoring force of a reset spring that elastically supports the reset valve.

The compression release type of engine brake socket module according to an exemplary form of the present disclosure and the engine brake operation method of the engine brake using the same may be provided with a stopper for limiting a position of a brake valve, thereby preventing the brake valve from being separated from the housing with simplified scheme.

The compression release type of engine brake socket module according to an exemplary form of the present disclosure and the engine brake operation method of the engine brake using the same automatically exhaust the brake oil introduced into the housing during engine brake operation by being provided with a reset member such that It is possible to prevent the exhaust valve from contacting the engine piston.

In addition, effects obtained or predicted by the exemplary form of the present disclosure are disclosed directly or implicitly in a detailed description of an exemplary form of the present disclosure. That is, various effects predicted according to an exemplary form of the present disclosure will be disclosed in a detailed description to be described later.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
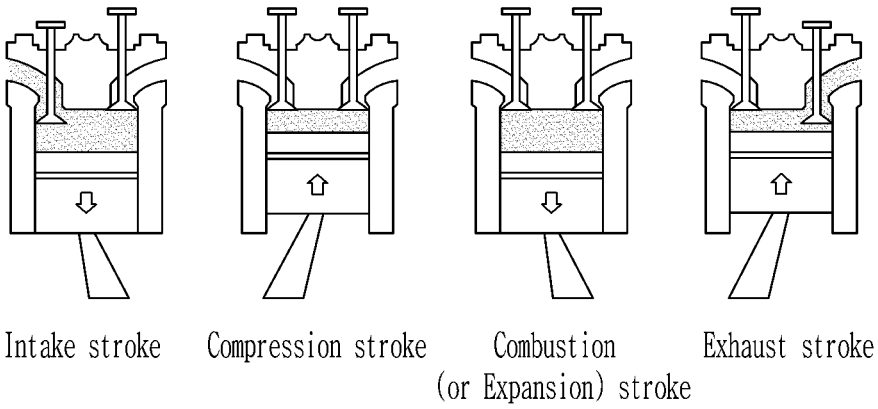
FIG. 1 is a schematic diagram of a basic four-stroke cycle of an engine.

FIG. 7 to FIG. 10 sequentially illustrate an operation of the compression release type engine brake; and FIG. 11 is a graph that shows a valve lift displacement amount occurring in use of a general compression release type of engine brake.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure will be described more fully hereinafter with reference to the accompanying drawings, in which exemplary forms of the present disclosure are shown. As those skilled in the art would realize, the described forms may be modified in various different ways, all without departing from the spirit or scope of the present disclosure.

In the following description, dividing names of components into first, second, and the like is to divide the names because the names of the components are the same as each other, and an order thereof is not particularly limited.

Figure 2:
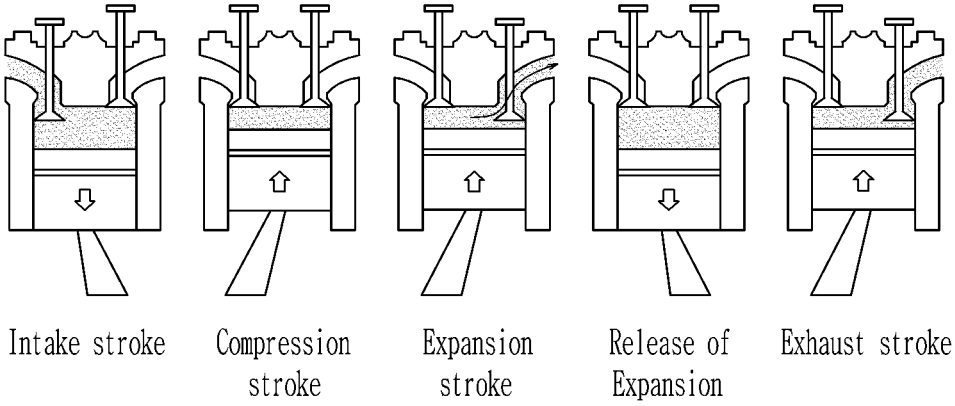
FIG. 2 is a schematic diagram of an engine cycle for description of a compression release type of engine brake.

FIG. 1 is a schematic diagram of a basic four-stroke cycle of an angle, and FIG. 2 is a schematic diagram of an engine cycle for description of a compression release type of engine brake according to an exemplary form of the present disclosure.

In general, the engine brake may be applied to prevent the vehicle from causing premature wear of the brake pads applied to the foot brake when driving downhill or when frequently stopping suddenly.

The compression release type of engine brake is actuated in one of the four basic strokes of the engine, and opens an exhaust valve at the end of a compression stroke so that the engine can perform its braking function.

Referring to FIG. 1, a vehicle engine is driven by repeating a four-stroke cycle of intake, compression, combustion, and exhaust when driving.

As shown in FIG. 2, the compression release type of engine brake temporarily opens an exhaust valve at the end of the compression stroke, that is, near a top dead center of the piston, to exhaust compressed air in a cylinder to the outside the cylinder, thereby acquiring a braking effect by inducing a pumping loss in the expansion stroke.

For this, the compression release type of engine brake according to the exemplary form of the present disclosure may be formed as follows.

Figure 3:
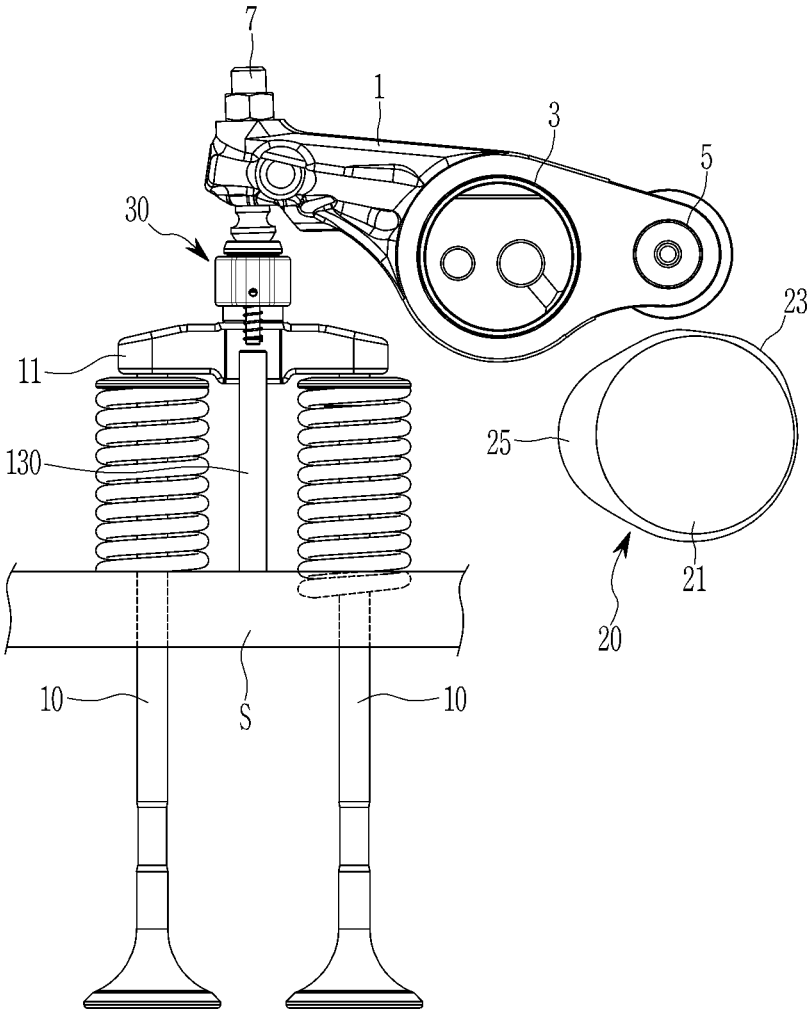
FIG. 3 is a schematic diagram of the compression release type of engine brake.

FIG. 3 is a schematic diagram of the compression release type of engine brake according to the exemplary form of the present disclosure.

Referring to FIG. 3, in the compression release type engine brake, a rocker arm shaft 3 is inserted into an exhaust rocker arm 1 such that the exhaust rocker arm 1 rotates with respect to the rocker arm shaft 3, a roller 5 is mounted to one end of the exhaust rocker arm 1, and an adjusting screw 7 is mounted to the other end of the exhaust rocker arm 1.

The roller 5 is formed to contact or not contact an exhaust cam 20 installed on a camshaft.

The adjusting screw 7 is mounted to the other end of the exhaust valve 10 and is thus connected with a valve bridge 11 through a socket module 30 provided at a lower end thereof.

The valve bridge 11 is connected to the exhaust valve 10, and the exhaust valve 10 may be provided as a pair.

In addition, the exhaust cam 20 may be divided into a brake cam lobe section and a main cam lobe section according to a profile, and the brake cam lobe section and the main cam lobe section may be implemented by forming a brake cam lobe 23 and a main cam lobe 25 on the exhaust cam shaft 21.

The main cam lobe 25 may implement the exhaust stroke by contacting the roller 5, and the brake cam lobe 23 may open the exhaust valve 10 by contacting the roller 5 when the engine brake is operated.

In addition, a bias spring (not shown) is mounted to the exhaust rocker arm 1, and the bias spring lifts one end of the exhaust rocker arm 1, which corresponds to the roller 5, and the same time, provides an elastic force in a direction in which the other end of the exhaust rocker arm 1, which corresponds to the adjusting screw 7, to be closely attached to the valve bridge 11.

Accordingly, in a state before the engine brake operation (in the basic engine stroke), the roller 5 maintains a distance with the brake cam lobe 23 of the exhaust cam 20, and, in the exhaust stroke, the roller 5 is pushed upward only by the main cam lobe 25 of the exhaust cam 20.

That is, when brake oil for operation of the engine brake is not supplied, a gap is formed between the roller 5 provided at the other end of the exhaust rocker arm 1 and the exhaust cam 20 and thus the brake cam lobe 23 of the exhaust cam 20 and the roller 5 do not contact each other, thereby causing the engine brake not to work.

On the other hand, when the engine brake oil is supplied to operate the engine brake, the socket module 30 lifts the other side of the exhaust rocker arm 1 up such that the roller 5 and the exhaust cam 20 are in constant contact, and thus, at the end of the compression stroke, the exhaust rocker arm 1 is operated by the brake cam lobe 23 of the exhaust cam 20, so that the braking effect can be obtained.

The socket module 30 is applied between the exhaust rocker arm 1 and the valve bridge 11.

Figure 4:
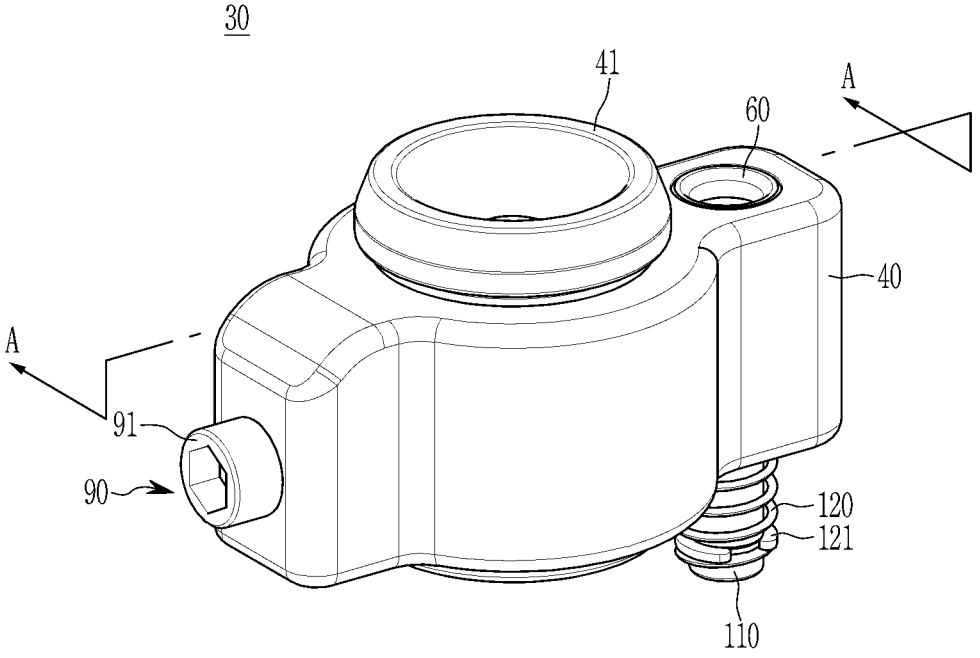
FIG. 4 is a perspective view of the socket module of the compression release type of engine brake.
Figure 5:
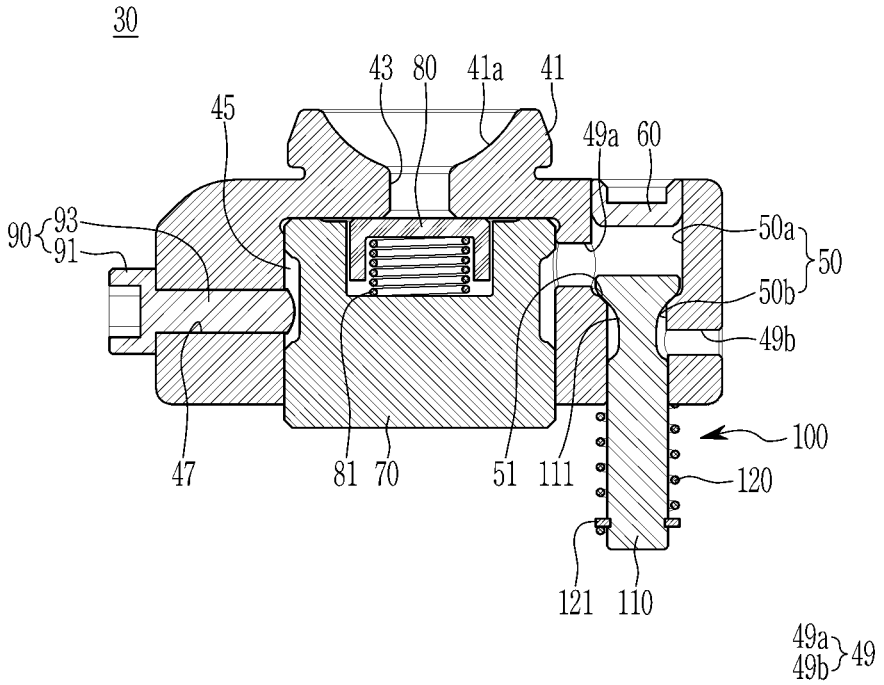
FIG. 5 is a cross-sectional view of FIG. 4, taken along the line A-A.
Figure 6:
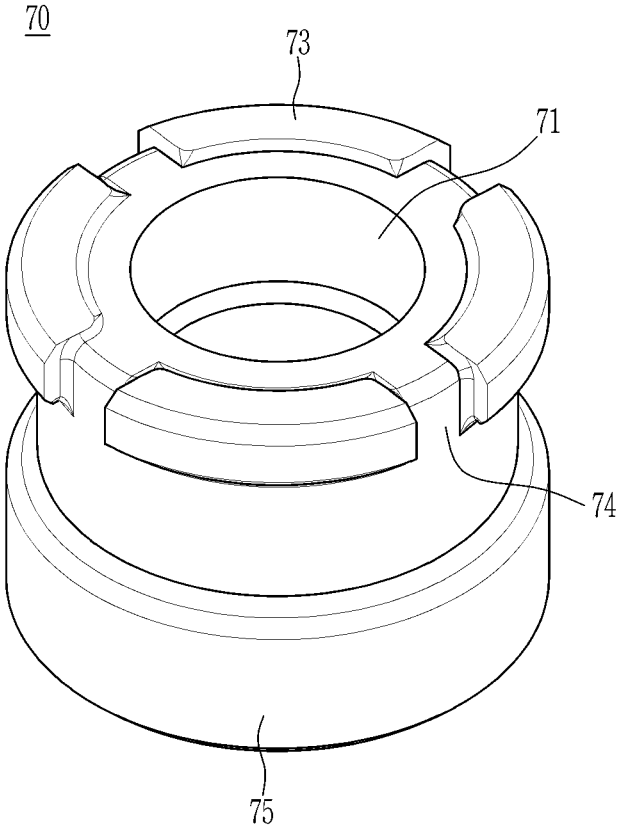
FIG. 6 is a perspective view of a brake piston applied to the compression release type of engine brake.

FIG. 4 is a perspective view of the socket module of the compression release type of engine brake according to an exemplary form of the present disclosure, and FIG. 5 is a cross-sectional view of FIG. 4, taken along the line A-A. FIG. 6 is a perspective view of a brake piston applied to the compression release type of engine brake according to an exemplary form of the present disclosure.

Referring to FIG. 4 to FIG. 6, the socket module 30 of the compression release type of engine brake includes a housing 40, a brake piston 70, a stopper 90 and a reset member 100.

The housing 40 includes a mounting portion 41 that protrudes upward from a center of an upper center thereof.

The mounting portion 41 includes a rounded mounting groove 41*a* provided therein such that the adjusting screw 7 is mounted thereto.

An inlet 43 connected with the mounting groove 41*a* is formed at a lower center of the mounting portion 41.

In addition, a brake piston mounting portion 45 is formed at a lower side of the inlet 43.

An upper end of the brake piston mounting portion 45 is connected with the inlet 43 inside the housing 40, and a lower end of the brake piston mounting portion 45 is opened.

A stopper mounting portion 47 is formed on one side of the brake piston mounting portion 45.

The stopper mounting portion 47 may be formed long in the left and right directions.

The outlet 49 is formed to the other side of the brake piston mounting portion 45.

A reset member mounting portion 50 is formed in a vertical direction on the outlet 49, and the reset member mounting portion 50 includes a first passage 50*a* and a second passage 50*b*, each having a different diameter.

The first passage 50*a* is communicated with a first outlet 49*a* that is connected with the brake piston mounting portion 45.

An upper portion of the first passage 50*a* may be closed by a cap 60.

The second passage 50*b* is provided at a lower side of the first passage 50*a* and connected with the first passage 50*a* through a slanted surface 51, and a diameter of the second passage 50*b* is smaller than that of the first passage 50*a*.

A second outlet 49*b* that penetrates side surfaces of the housing 40 is connected at one side of the second passage 50*b*.

The brake piston 70 and the reset member 100 are inserted into the housing 40.

The brake piston 70 is movably provided in the brake piston mounting portion 45, and is connected with the valve bridge 11.

Referring to FIG. 6, the brake piston 70 is formed in a shape of a cylinder as a whole, and a receiving groove 71 that is concave downward is formed in the lower portion of the upper central portion.

A check valve 80 that opens and closes the inlet 43 is disposed in the receiving groove 71.

The check valve 80 is elastically supported by a check spring 81 that is mounted to a center of the receiving groove 71 to open and close the inlet 43 while vertically driving.

An upper protrusion 73 and a lower protrusion 75 are formed on the exterior surfaces of the upper and lower parts of the brake piston 70.

The upper protrusion 73 is formed in a plurality, and is spaced apart each other along the circumference, enclosing a certain area of the upper and side surfaces connected to the upper edge of the brake piston 70.

The upper protrusion 73 may be formed to be spaced apart at regular intervals along the circumference.

The lower protrusion 75 is protruded along the lower side of the brake piston 70.

An upper passage 74 is formed between each upper protrusion 73 so that the oil is easily exhausted through the outlet 49.

That is, the oil flowed into the inlet 43 is exhausted through the outlet 49 through the space, that is the upper passage 74, between the upper protrusion 73 and the lower protrusion 75 when exhausted.

The brake piston 70 operates in a vertical direction along the brake piston mounting portion 45 by brake oil introduced into the housing 40.

At this time, the position of the brake piston 70 in the up and down direction is regulated by the stopper 90, and the stopper 90 is mounted through the stopper mounting portion 47 of the housing 40.

The stopper 90 includes a head portion 91 and a body portion 93.

The body portion 93 is integrally formed with the head portion 91 and inserted into the stopper mounting portion 47.

The stopper 90 is mounted so that an end of the body portion 93 is protruded into the brake piston mounting portion 45 at a position between the upper and lower protrusions 73 and 75.

Since the stopper 90 is positioned between the upper protrusion 73 and the lower protrusion 75 of the brake piston 70, the stopper is configured to limit the position of the brake piston 70.

The stopper 90 can adjust the insert length of the body portion 93 in the form of a screw.

The reset member 100 is inserted to be vertically operated through the reset member mounting portion 50 of the housing 40.

The reset member 100 includes a reset valve 110 that opens and closes the first and second outlets 49*a* and 49*b* of the housing 40 by being inserted into the reset member mounting portion 50.

A flow path groove 111 that is concave inward is formed at an exterior circumference of an upper side of the reset valve 110.

An upper end of the reset valve 110 is supported by being locked by the slanted surface 51 formed between the first passage 50*a* and the second passage 50*b* and thus supported so as to not escape in the downward direction.

In one form, a diameter of the upper end of the reset valve 110 is larger than a portion of the reset valve 110 inserted into the second passage 50*b* corresponding to the first passage 50*a*.

The reset valve 110 is provided to be movable in a vertical direction by a reset spring 120 that elastically supports a lower end of the reset valve 110 from the outside the housing 40.

In a state that the reset valve 110 is inserted in the reset spring 120, a lower end of the reset spring 120 is fixed by a spring pin 121 mounted on the lower portion of the reset valve 110.

Here, the reset valve 110 is operated by a push pin 130 (refer to FIG. 3) that is mounted to one side of a cylinder head S.

The push pin 130 may be mounted to a top surface of the cylinder head S. A method of operating the engine brake using the socket module 30 configured as described above is as follows.

FIG. 7 to FIG. 10 sequentially illustrate an operation of the compression release type engine brake according to an exemplary form of the present disclosure.

Figure 7:
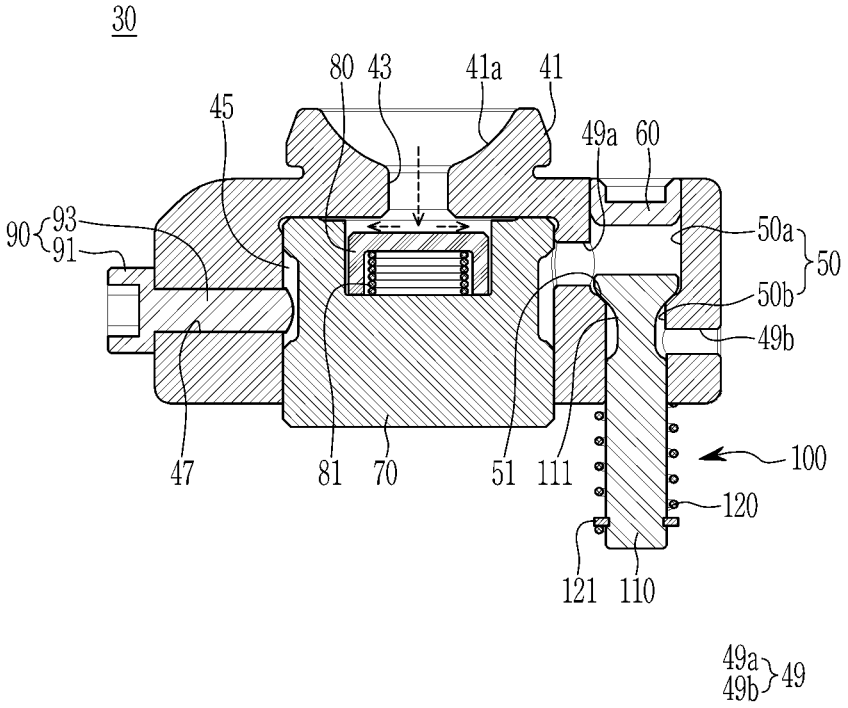

Referring to FIG. 7, when the engine brake is operated, the brake oil flows through a flow path inside the adjusting screw 7 to the inlet 43 of the housing 40.

Then, the check valve 80 that opens and closes the inlet 43 descends to open the inlet 43 and then is mounted inside the receiving groove 71.

Figure 8A:
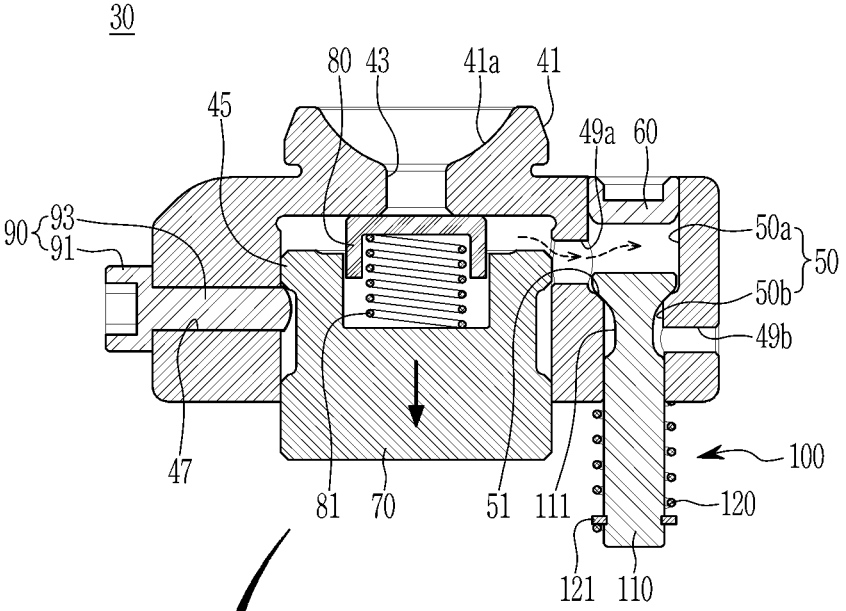
Figure 8B:
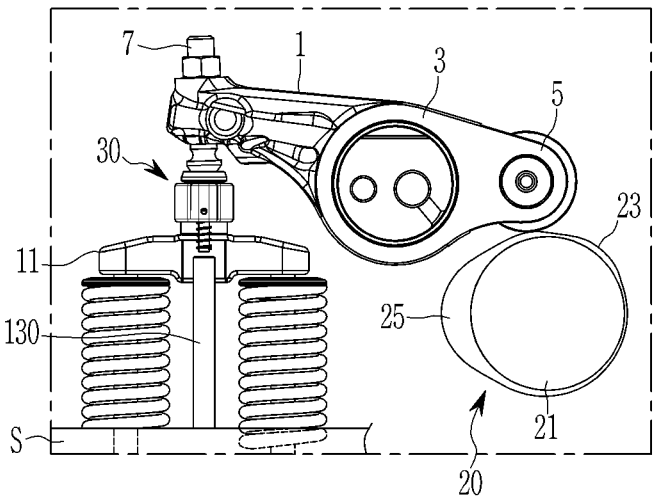

Referring to FIGS. 8A and 8B, when brake oil is introduced into the brake piston mounting portion 45, the brake piston 70 descends by a hydraulic pressure and, at the same time, the check valve 80 closes the inlet 43 by an elastic force of the check spring 81 such that the brake piston mounting portion 45 is closed and sealed.

Here, the position of the brake piston 70 is limited by the upper protrusion 73 and stopper 90.

In this case, as the brake piston 70 relatively descends, the exhaust rocker arm 1 rotates relative to the rocker arm shaft 3, and the roller 5 of the exhaust rocker arm 1 contacts the exhaust cam 20.

Subsequently, when the exhaust cam 20 rotates and thus the brake cam lobe 23 of the exhaust cam 20 and the roller 5 contact each other, an end portion of the exhaust rocker arm 1, corresponding to the roller 5, is lifted upward and rotates with reference to the rocker arm shaft 3 by the protruded brake cam lobe 23.

Due to such an operation, the valve bridge 11 is pressed downward and the exhaust valve 10 is opened. That is, at the end of the compression stroke, that is, near the top dead center of the piston, the exhaust valve 10 is temporarily opened to exhaust the compressed air in the cylinder out of the cylinder, thereby inducing a pumping loss of the expansion stroke to obtain a braking effect.

Figure 9:
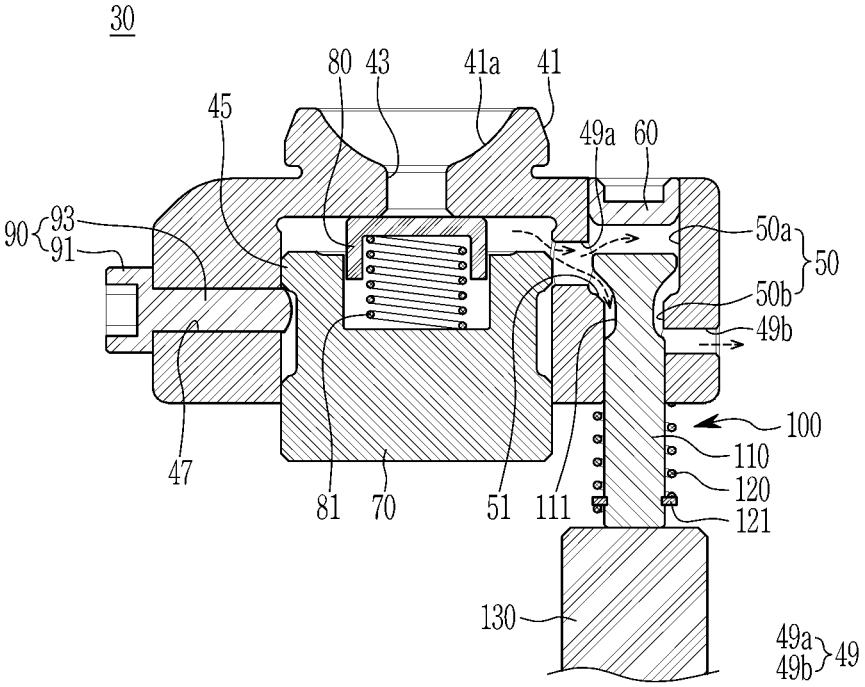

Referring to FIG. 9, as the exhaust rocker arm 1 rotates, the reset valve 110 contacts the push pin 130 such that the reset valve 110 moves upward.

In this case, the first outlet 49*a* and the second outlet 49*b* are opened through the flow path groove 111 of the reset valve 110.

The brake oil introduced into the brake piston mounting portion 45 is exhausted through the first outlet 49*a* and the second outlet 49*b*.

Figure 10:
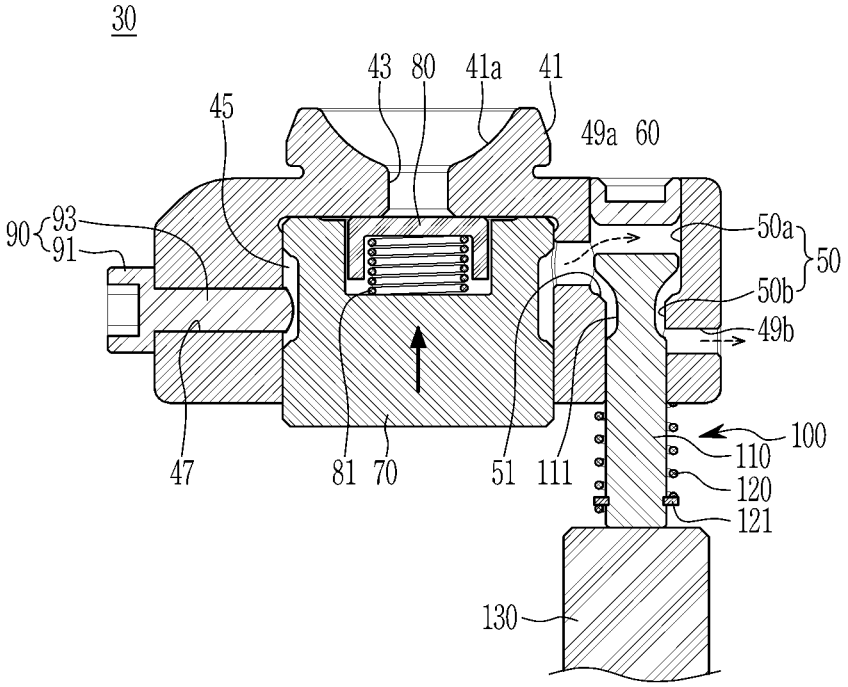

Referring to FIG. 10, when the brake oil in the housing 40 is completely exhausted, the brake piston 70 moves upward and the reset valve 110 automatically returns to an initial state such that the roller 5 and the exhaust cam 20 maintain a constant gap therebetween.

Thus, the socket module of the compression release type of engine brake according to the exemplary form of the present disclosure and the operation method of the engine brake using the same apply the stopper 90 that limits the position of the brake valve, so that the brake valve can be prevented from coming off the housing 40 with a simple structure.

Accordingly, the socket module of the compression release type of engine brake and the operation method can prevent product defects and improve product performance and durability.

Thus, the socket module of the compression release type of engine brake according to the exemplary form of the present disclosure and the operation method of the engine brake using the same apply the reset member 100 to automatically exhaust the brake oil introduced into the housing 40 during engine brake operation so that it is possible to prevent the exhaust valve 10 from contacting the engine piston.

That is, the oil in the socket module is exhausted every cycle, so that the valve lift can be kept constant when the exhaust valve 10 is opened by the main cam lobe 25.

While this present disclosure has been described in connection with what is presently considered to be practical exemplary forms, it is to be understood that the present disclosure is not limited to the disclosed forms. On the contrary, it is intended to cover various modifications and equivalent arrangements included within the spirit and scope of the present disclosure.

<Description of symbols>

| | |
|---|---|
| 1: exhaust rocker arm | 3: rocker arm shaft |
| 5: roller | 7: adjusting screw |
| 10: exhaust valve | 11: valve bridge |
| 20: exhaust cam | 21: exhaust camshaft |
| 23: brake cam lobe | 25: main cam lobe |
| 30: socket module | 40: housing |
| 41: mounting portion | 41a: mounting groove |
| 43: inlet | 45: brake piston mounting portion |
| 47: stopper mounting portion | 49: outlet |
| 49a: first outlet | 49b: second outlet |
| 50: reset member mounting portion | |
| 50a: first passage | |
| 50b: second passage | 51: slanted surface |
| 60: cap | 70: brake piston |
| 71: receiving groove | 73: upper protrusion |
| 75: lower protrusion | 80: check valve |
| 81: check spring | 90: stopper |
| 91: head portion | 93: body portion |
| 100: reset member | 110: reset valve |
| 111: flow path groove | 120: reset spring |
| 121: spring pin | 130: push pin |

What is claimed is:

1. A compression-release engine brake socket module provided between an exhaust rocker arm rotating with respect to a rocker arm shaft and a valve bridge connected to an exhaust valve, the compression-release engine brake socket module comprising:

a housing including:

an inlet through which brake oil is introduced, a brake piston mounting portion, and a reset member mounting portion configured to communicate with the brake piston mounting portion;

a brake piston configured to move in the brake piston mounting portion;

a stopper disposed on one side of an inner space of the housing and configured to limit a moving position of the brake piston; and a reset member provided in the reset member mounting portion, and configured to discharge the brake oil by selectively contacting a push pin coupled to an upper portion of a cylinder head.

2. The compression-release engine brake socket module of claim 1, further comprising at least one upper protrusion formed on an upper portion of an exterior surface of the brake piston and a lower protrusion formed on a lower portion of the exterior surface wherein the at least one upper protrusion and the lower protrusion are configured to alternately engage the stopper so as to limit the moving position of the brake piston.

3. The compression-release engine brake socket module of claim 2, wherein the housing is formed with a stopper mounting portion in which the stopper is inserted.

4. The compression-release engine brake socket module of claim 2, wherein the at least one upper protrusion includes a plurality of upper protrusions spaced apart from each other along a circumference of the upper portion of the exterior surface, and wherein the plurality of upper protrusions extends from the upper portion of the exterior surface in a radial direction and an axial direction of the brake piston.

5. The compression-release engine brake socket module of claim 4, wherein an upper passage is formed between adjacent upper protrusions of the plurality of upper protrusions.

6. The compression-release engine brake socket module of claim 5, wherein:

the stopper includes a head portion and a body portion, the body portion is inserted through a stopper mounting portion of the housing, and an end of the body portion is protruded into the brake piston mounting portion at a position between the at least one upper protrusion and the lower protrusion.

7. The compression-release engine brake socket module of claim 1, wherein the housing further includes:

a rounded mounting groove protruded upward from an upper center of the housing where an adjusting screw of the exhaust rocker arm is mounted.

8. The compression-release engine brake socket module of claim 1, wherein the reset member mounting portion comprises:

a first passage connected to the brake piston mounting portion through a first outlet; and a second passage configured to discharge the brake oil, the second passage connected to the first passage through a slanted surface, wherein a diameter of the second passage is less than a diameter of the first passage.

9. The compression-release engine brake socket module of claim 1, wherein a receiving groove is formed in an upper portion of the brake piston.

10. The compression-release engine brake socket module of claim 9, wherein a check valve is disposed in the receiving groove, the check valve configured to open and close the inlet, wherein the check valve is elastically supported by a check spring.

11. The compression-release engine brake socket module of claim 1, wherein the reset member comprises:

a reset valve configured to move in the reset member mounting portion so as to open and close an outlet of the housing; and a reset spring configured to elastically support a lower portion of the reset valve, wherein the brake oil is discharged when the push pin pushes the reset valve.

12. The compression-release engine brake socket module of claim 11, wherein:

an upper exterior circumference of the reset valve is recessed so as to form a flow path groove, and an upper portion of the reset valve is locked by a slanted surface of the housing such that the reset valve does not escape the housing in a downward direction.

13. A method for operating a compression-release engine brake using a socket module provided between an exhaust rocker arm and a valve bridge, the socket module comprising a housing including an inlet, a brake piston mounting portion, a reset member mounting portion, a brake piston, and a reset member, the method comprising:

providing brake oil to the brake piston mounting portion through the inlet so as to actuate the brake piston;

rotating the exhaust rocker arm in a first direction relative to a rocker arm shaft such that a roller of the exhaust rocker arm contacts an exhaust cam when the brake piston is actuated;

rotating the exhaust rocker arm in a second direction relative to the rocker arm shaft when a brake cam lobe of the exhaust cam engages the roller such that the exhaust rocker arm presses the valve bridge so as to open an exhaust valve; and pushing a reset valve of the reset member via a push pin as the exhaust rocker arm rotates in the second direction such that an outlet of the housing is opened, the push pin coupled to an upper portion of a cylinder head.

14. The method of claim 13, wherein the providing of the brake oil comprises:

introducing the brake oil into the housing via a flow path formed in an adjusting screw of the exhaust rocker arm; and opening a check valve which closes the inlet so as to introduce the brake oil into the brake piston mounting portion.

15. The method of claim 13, wherein the actuating of the brake piston comprises:

raising a check valve via a restoring force of a check spring so as to close the inlet, and simultaneously lowering a position of the brake piston until an upper protrusion of the brake piston contacts a stopper; and supporting the brake piston via the valve bridge such that the housing is lifted so as to rotate the exhaust rocker arm in the first direction until the roller contacts the exhaust cam.

16. The method of claim 13, wherein the pushing of the reset valve comprises:

moving the reset valve upward via the push pin while the exhaust cam rotates, and opening a first outlet and a second outlet through a flow path groove formed in the reset valve, and discharging the brake oil through the first outlet and the second outlet.

17. The method of claim 16, further comprising: moving the reset valve downward via a restoring force of a reset spring that elastically supports the reset valve after the brake oil is discharged.

* * * * *